US009060666B2

(12) United States Patent
Jang et al.

(10) Patent No.: US 9,060,666 B2
(45) Date of Patent: Jun. 23, 2015

(54) ROBOT CLEANER, AUTOMATIC EXHAUST STATION AND ROBOT CLEANER SYSTEM HAVING THE SAME

(75) Inventors: Hwi Chan Jang, Yongin-si (KR); Dong Won Kim, Hwaseong-si (KR); Hyun Soo Jung, Seongnam-si (KR); Jun Hwa Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 922 days.

(21) Appl. No.: 13/317,299

(22) Filed: Oct. 14, 2011

(65) Prior Publication Data

US 2012/0102670 A1 May 3, 2012

(30) Foreign Application Priority Data

Nov. 3, 2010 (KR) ..... 10-2010-0108480

(51) Int. Cl.

| | |
|---|---|
| ***A47L 9/10*** | (2006.01) |
| ***A47L 9/20*** | (2006.01) |
| ***A47L 11/33*** | (2006.01) |
| ***A47L 11/40*** | (2006.01) |
| ***A47L 9/14*** | (2006.01) |

(52) U.S. Cl.

CPC ..... *A47L 11/33* (2013.01); *A47L 11/4025* (2013.01); *A47L 11/4072* (2013.01); *A47L 2201/024* (2013.01); *A47L 9/1463* (2013.01); *A47L 2201/00* (2013.01)

(58) Field of Classification Search

CPC ... A47L 9/1463; A47L 11/33; A47L 11/4025; A47L 2201/00; A47L 2201/024

USPC ..... 15/319, 339, 347, 352, 353

IPC ..... A47L 9/10,9/20

See application file for complete search history.

(56) References Cited

U.S. PATENT DOCUMENTS

| | | | | |
|---|---|---|---|---|
| 8,635,739 | B2 * | 1/2014 | Lee et al. | 15/319 |
| 8,650,703 | B2 * | 2/2014 | Kim et al. | 15/319 |
| 8,732,901 | B2 * | 5/2014 | Shim et al. | 15/347 |
| 2008/0201895 | A1 * | 8/2008 | Kim et al. | 15/319 |
| 2012/0291809 | A1 * | 11/2012 | Kuhe et al. | 134/18 |

FOREIGN PATENT DOCUMENTS

| | | | |
|---|---|---|---|
| CN | 1833594 | * | 9/2006 |
| KR | 10-2008-0079075 | | 8/2008 |
| KR | 10-2009-0038965 | | 4/2009 |
| WO | WO2011/004915 | * | 1/2011 |

OTHER PUBLICATIONS

Korean Office Action issued Aug. 14, 2014 in corresponding Korean Patent Application No. 10-2010-0108480.

* cited by examiner

*Primary Examiner* — David Redding

(74) *Attorney, Agent, or Firm* — Staas & Halsey LLP

(57) ABSTRACT

A robot cleaner provided with a shutter to open or close an inlet of a dust box when the dust box is separated from a body of the robot cleaner. Another robot cleaner, which docks with an automatic exhaust station, is also disclosed, together with the automatic exhaust station. The latter robot cleaner includes a shutter to be automatically opened by air discharged from the automatic exhaust station in a docked state of the robot cleaner to exhaust dust from the dust box, in order to allow even heavy dust to be easily exhausted.

25 Claims, 20 Drawing Sheets

ROBOT CLEANER, AUTOMATIC EXHAUST STATION AND ROBOT CLEANER SYSTEM HAVING THE SAME

CROSS-REFERENCE TO RELATED APPLICATIONS

This application claims the benefit of Korean Patent Application No. 2010-108480 filed on Nov. 3, 2010 in the Korean Intellectual Property Office, the disclosure of which is incorporated herein by reference in its entirety.

BACKGROUND

1. Field

Embodiments of the present disclosure relate to a robot cleaner which includes a dust box separably mounted to a body, performs a cleaning operation while traveling autonomously, and docks with an automatic exhaust station to automatically exhaust dust from the dust box to the automatic exhaust station.

2. Description of the Related Art

A robot cleaner includes various sensors, a driving unit, and a cleaning unit to perform cleaning while traveling autonomously.

Generally, in such a robot cleaner, a separable dust box is mounted to a body of the robot cleaner. Accordingly, the user can exhaust dust collected in the dust box after separating the dust box from the body. However, when the separated dust box is shaken or turned over, the dust collected in the dust box may be unintentionally discharged.

To this end, it may be necessary to provide a structure to allow an inlet of the dust box to be opened during a cleaning operation while maintaining the inlet of the dust box in a closed state when the dust box is separated from the body.

Meanwhile, there is a system enabling the robot cleaner to dock with an automatic exhaust station so as to automatically exhaust dust from the dust box to the automatic exhaust station. In such a system, however, it may be difficult to discharge heavy items (including coins and other heavy granules) from the dust box because the heavy items may be trapped by a stepped structure formed at the inlet of the dust box.

SUMMARY

It is an aspect of the present disclosure to provide a robot cleaner having a shutter structure to prevent dust collected in a dust box from being unintentionally discharged.

It is another aspect of the present disclosure to provide a robot cleaner having a shutter structure to enable easy discharge of heavy dust when the robot cleaner docks with an automatic exhaust station to automatically exhaust dust from a dust box to the automatic exhaust station.

Additional aspects and/or advantages will be set forth in part in the description which follows and, in part, will be apparent from the description, or may be learned by practice of the disclosure.

In accordance with one aspect of the present disclosure, a robot cleaner includes a body, a dust box separably mounted to the body, the dust box including a dust box inlet, a first shutter rotatably coupled to the dust box; and a second shutter rotatably coupled to the dust box to open or close a portion of the dust box inlet, wherein the first shutter opens or closes a remaining portion of the dust box inlet.

The first shutter may include a shutter rotating shaft arranged at the dust box inlet while extending in a longitudinal direction of the first dust box inlet.

The first shutter may be pivotally coupled to outer side surfaces of the dust box, to rotate vertically.

The first shutter may be opened when the first shutter is pressed by the body.

The first shutter may be closed by gravity when a pressing force applied from the body to the first shutter is removed.

The robot cleaner may further include a lever to rotate the first shutter.

The body may include a guide to press the lever, thereby opening the first shutter.

The guide may be formed with an inclined portion to cause the guide to gradually press the lever.

The robot cleaner may further include a magnet mounted to the first shutter to keep the first shutter closed.

A brush cleaning member may be formed at an end of the first shutter.

The second shutter may include a shutter rotating shaft arranged at the dust box inlet while extending in a longitudinal direction of the first dust box inlet.

The second shutter may be rotatably coupled to the body at a position inwardly spaced apart from the dust box inlet by a predetermined distance.

The second shutter may be opened by a pressure of air blown to the second shutter.

The second shutter may be closed by gravity when the air pressure is removed.

The air pressure may be generated by exhaust air discharged from an automatic exhaust station, with which the body docks.

The air pressure may be prevented from being applied to the second shutter when the first shutter is closed.

The robot cleaner may further include a stopper to limit a rotation range of the second shutter.

The robot cleaner may further include a magnet mounted to the second shutter to keep the second shutter closed.

In accordance with another aspect of the present disclosure, a robot cleaner includes a body, a dust box separably mounted to the body, the dust box including a dust box inlet, a first shutter rotatably coupled to the dust box such that the first shutter is opened when the dust box is mounted to the body while being closed when the dust box is separated from the body, and a second shutter rotatably coupled to the dust box such that the second shutter is opened when dust from the dust box is exhausted to an automatic exhaust station while being closed when the exhaust is completed.

In accordance with another aspect of the present disclosure, a robot cleaner includes a body, a dust box separably mounted to the body, the dust box including a dust box inlet, a shutter rotatably coupled to the dust box to open or close the dust box inlet, and a magnet mounted to the shutter to keep the shutter closed.

The dust box may be formed with a backflow preventing member to prevent dust collected in the dust box from flowing backwards.

In accordance with another aspect of the present disclosure, a robot cleaner includes a body, a dust box separably mounted to the body, the dust box including a dust box inlet, and a shutter rotatably coupled to the dust box to be rotated by a pressure of air blown to the shutter, thereby opening or closing the dust box inlet.

The second shutter may prevent dust collected in the dust box from flowing backwards in a closed state of the second shutter.

In accordance with still another aspect of the present disclosure, a robot cleaner system including a robot cleaner, and an automatic exhaust station, with which the robot cleaner docks, wherein the robot cleaner includes a body, a dust box separably mounted to the body, the dust box including a dust box inlet, and a shutter rotatably coupled to the dust box to be rotated by a pressure of air blown to the shutter, thereby opening or closing the dust box inlet.

The automatic exhaust station may include a discharge duct and a suction duct. The shutter may be rotated by air discharged from a discharge portion of the discharge duct, and dust from the dust box is sucked into a suction port of the suction duct by air sucked toward the suction port of the suction duct.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments of the present disclosure will be described with reference to the accompanying drawings.

Figure 1:
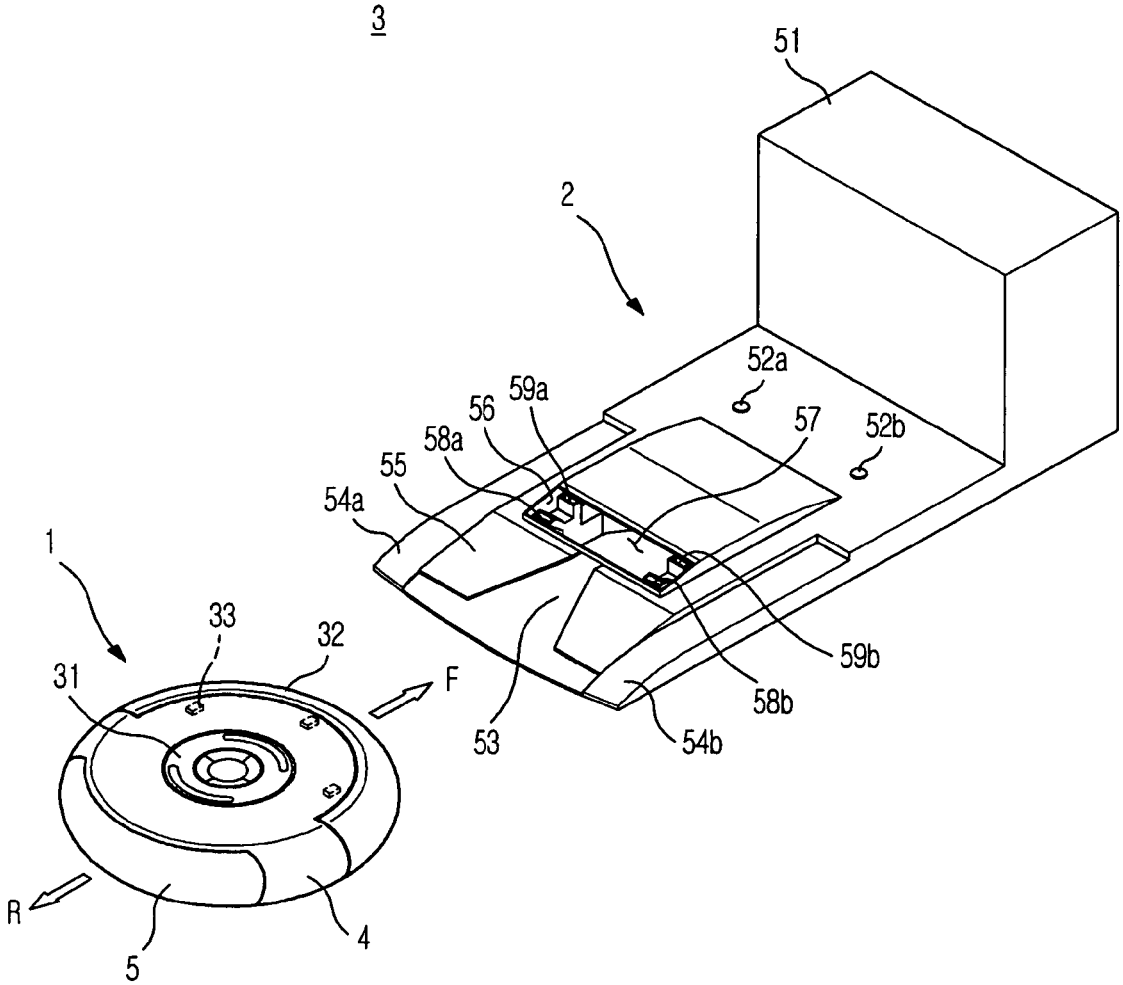
FIG. 1 is a perspective view illustrating a robot cleaner system including a robot cleaner and an automatic exhaust station in accordance with an exemplary embodiment of the present disclosure.

FIG. 1 is a perspective view illustrating a robot cleaner system including a robot cleaner and an automatic exhaust station in accordance with an exemplary embodiment of the present disclosure.

The robot cleaner system, which is designated by reference numeral 3, includes a robot cleaner 1, and an automatic exhaust station 2 with which the robot cleaner 1 may dock. The robot cleaner 1 includes a body 4, and a dust box 5 separably mounted to the body 4. The robot cleaner 1 travels autonomously using various sensors 33 and a driving unit, which are mounted to the body 4, while collecting dust accumulated on the floor into the dust box 5, to clean an area around the robot cleaner 1.

Figure 2:
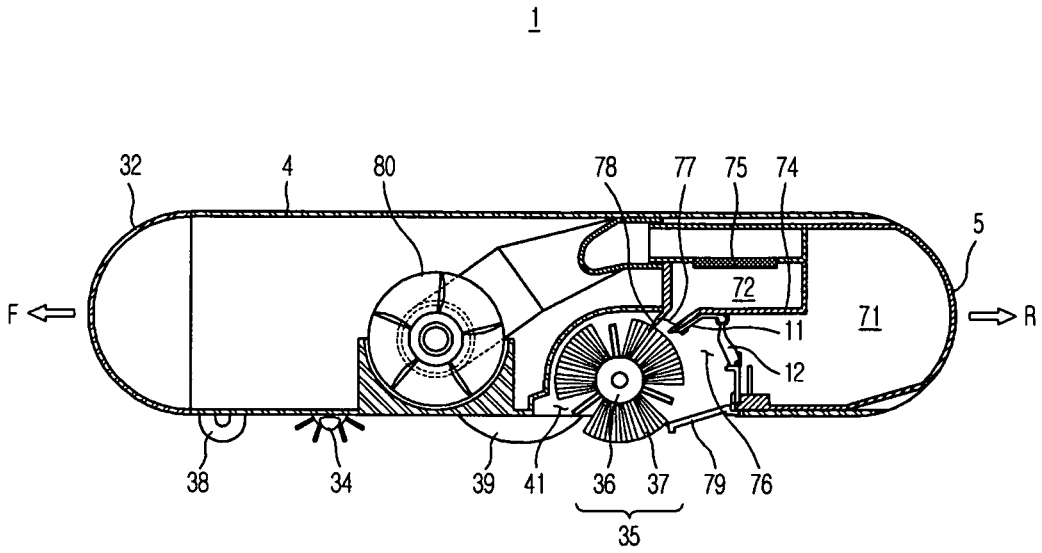
FIG. 2 is a sectional view illustrating a configuration of the robot cleaner according to an exemplary embodiment of the present disclosure.
Figure 3:
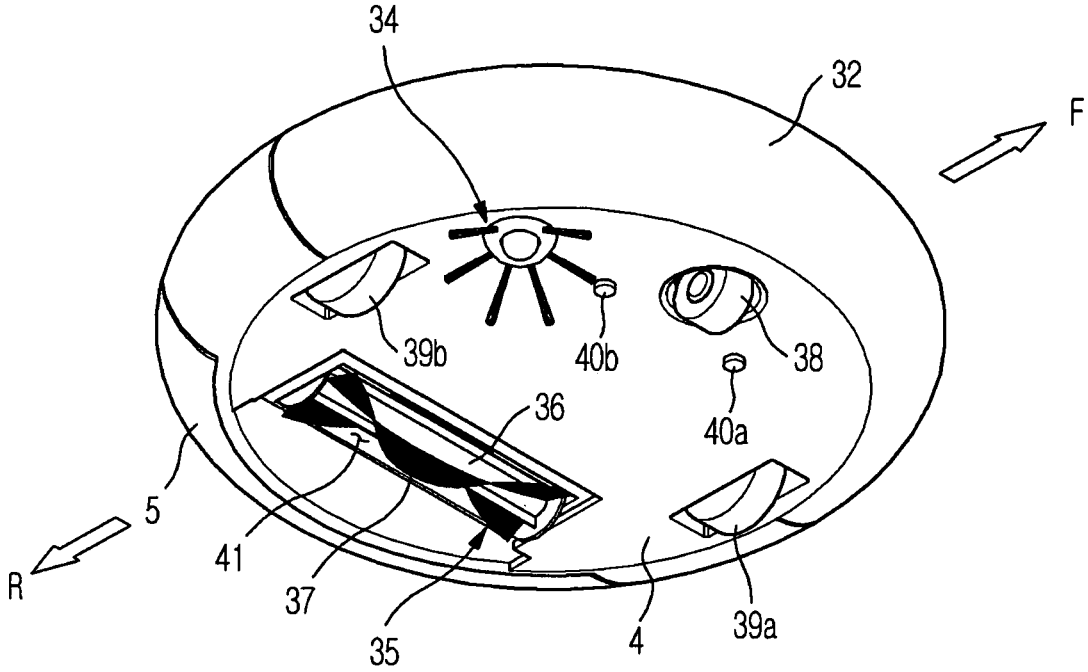
FIG. 3 is a bottom view illustrating the robot cleaner according to the illustrated embodiment of the present disclosure.

FIG. 2 is a sectional view illustrating a configuration of the robot cleaner according to an exemplary embodiment of the present disclosure. FIG. 3 is a bottom view illustrating the robot cleaner according to the illustrated embodiment of the present disclosure.

Hereinafter, the configuration of the robot cleaner according to the illustrated embodiment of the present disclosure will be described with reference to FIGS. 1 to 3. In the drawings, reference numeral "F" designates a front direction of the robot cleaner 1, and reference numeral "R" designates a rear direction of the robot cleaner 1.

As described above, the robot cleaner 1 includes the body 4, and the dust box 5, which is separably mounted to the body 4.

Left and right driving wheels 39*a* and 39*b*, and a caster 38 are mounted to the body 4, to enable the robot cleaner 1 to travel. The left and right driving wheels 39*a* and 39*b* are arranged at a central region on the bottom of the body 4, to enable the robot cleaner 1 to travel forwards or rearwards or to change the travel direction thereof. The caster 38 is arranged at a front region on the bottom of the body 4, to enable the robot cleaner 1 to maintain a stable posture.

A brush unit 35 and a side brush 34 are installed at the body 4, to clean a floor region beneath and around the body 4.

The brush unit 35 is mounted to a first opening 41 formed through the bottom of the body 4. The brush unit 35 includes a roller 36 rotatably mounted to the first opening 41 of the body 4, and a brush 37 made of an elastic material and provided at an outer peripheral surface of the roller 36. When the roller 36 rotates, the brush 37 sweeps dust on the floor. The swept dust is collected in the dust box 5 through the first opening 41.

The side brush 34 is rotatably mounted to one side of a peripheral portion of the bottom of the body 4, to move dust accumulated around the body 4 toward the brush unit 35. That is, the side brush 34 functions to expand the cleaning zone of the robot cleaner 1 to a region surrounding the body 4.

The robot cleaner 1 also includes connecting terminals 40*a* and 40*b* for charge of current, in order to receive current from the automatic exhaust station 2. The robot cleaner 1 further includes a bumper 32 installed to absorb impact generated when the robot cleaner 1 strikes an obstacle. A display 31 is also provided at the robot cleaner 1 to provide diverse information.

Meanwhile, the dust box 5 is mounted to a rear portion of the body 4. The dust box 5 has an internal storage chamber divided by a partition wall 74 into a first storage chamber 71 and a second storage chamber 72 arranged over the first storage chamber 71. The first and second storage chambers 71 and 72 are formed with first and second dust box inlets 76 and 77, respectively.

A dust guide 79 is arranged beneath the first inlet 76, to guide dust swept by the brush unit 35 toward the first dust box inlet 76.

The second storage chamber 72 communicates with a blowing unit 80 provided at the body 4. Light dust, which is difficult for the brush unit 35 to sweep, is upwardly dispersed during rotation of the brush unit 35, and then collected in the second storage chamber 72 by a sucking force of the blowing unit 80. A filter 75 is arranged between the second storage chamber 72 and the blowing unit 80, to prevent dust collected in the second storage chamber 72 from being sucked toward the blowing unit 80.

A brush cleaning member 78 is provided at the second dust box inlet 77, to filter off impurities such as hairs wound on and attached to the brush unit 35. Foreign matter filtered off by the brush cleaning member 78 is collected in the second storage chamber 72 by the sucking force of the blowing unit 80.

Meanwhile, first and second shutters 11 and 12 are mounted to the dust box 5, to open or close the first dust box inlet 76. The first and second shutters 11 and 12 will be described later in detail in conjunction with the automatic exhaust station.

Figure 4:
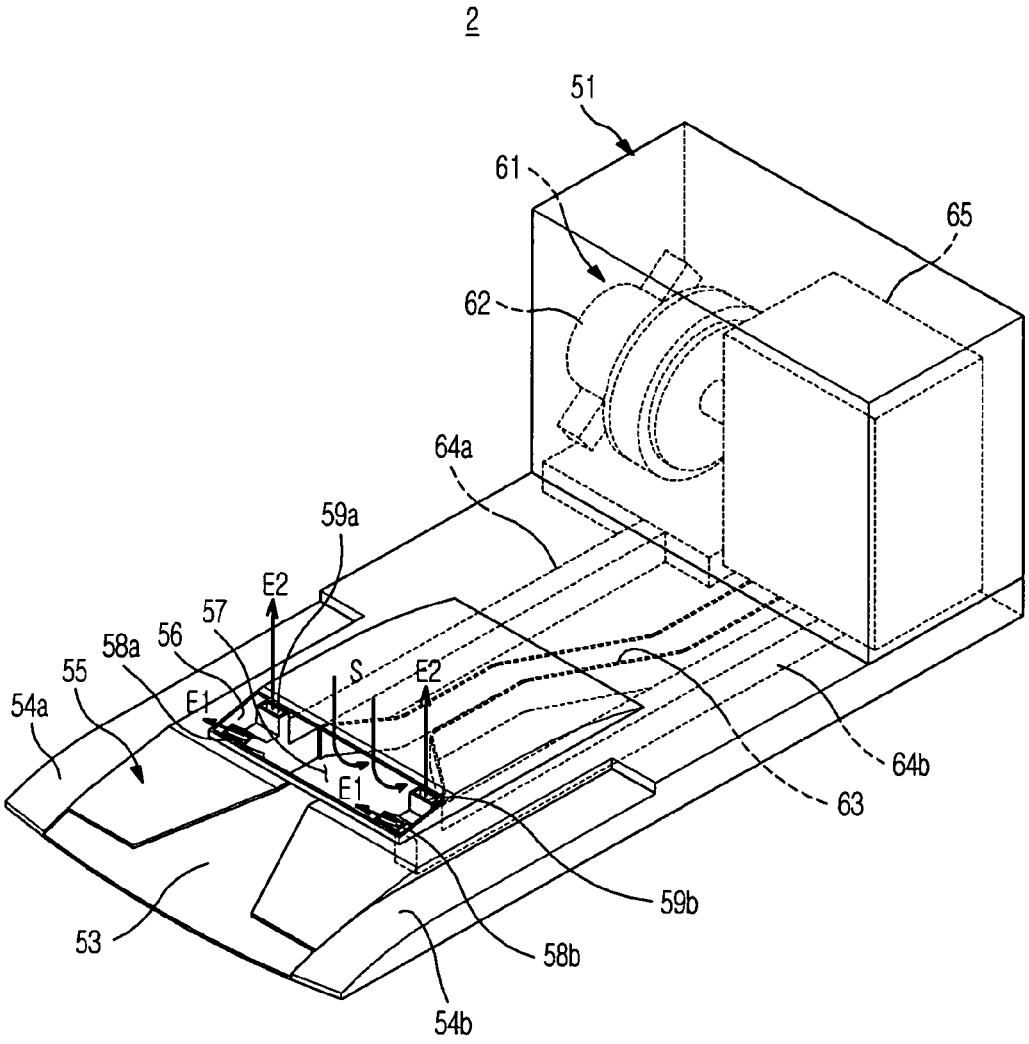
FIG. 4 is a perspective view illustrating a configuration of the automatic exhaust station according to an exemplary embodiment of the present disclosure.
Figure 5:
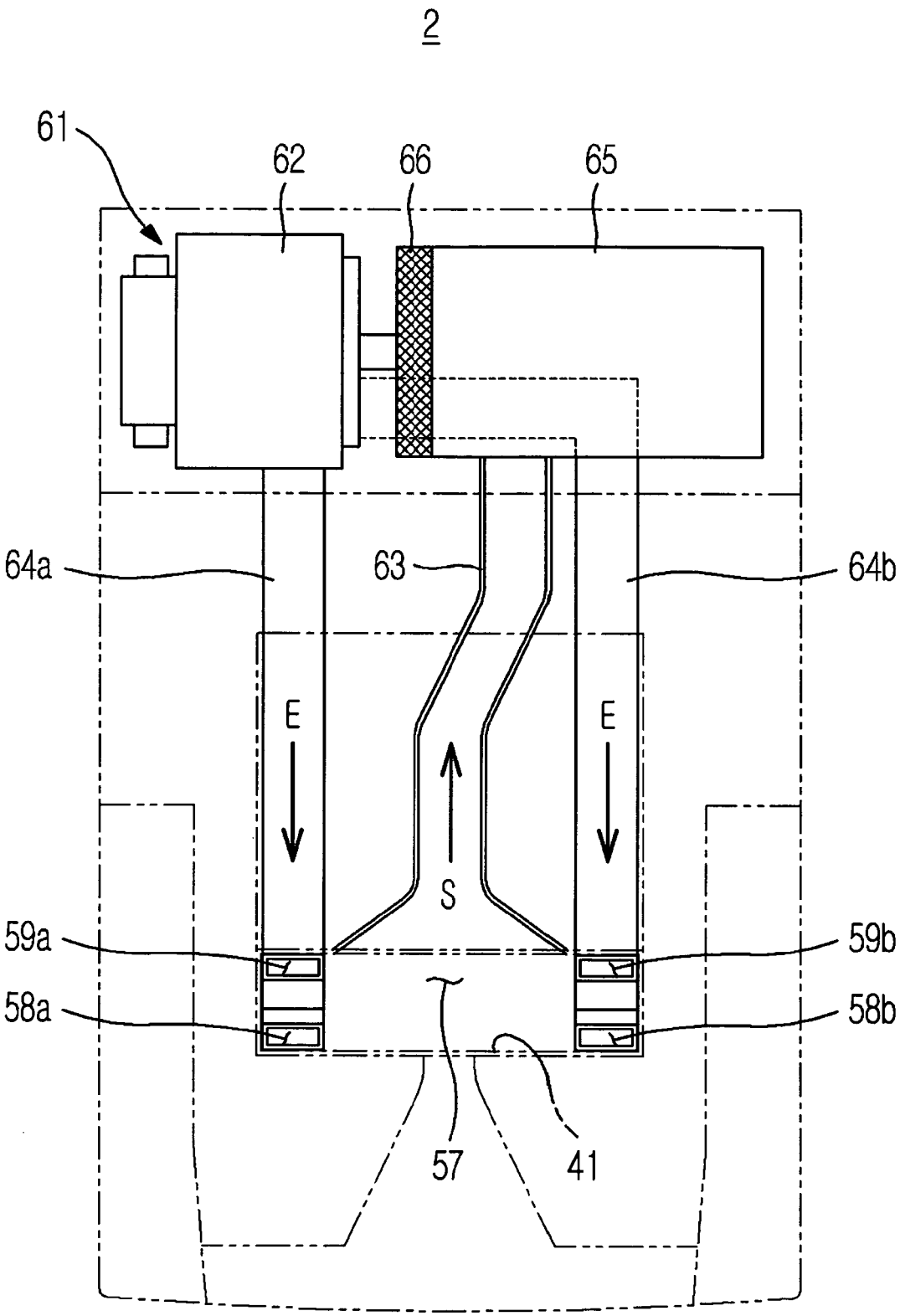
FIG. 5 is a plan view illustrating the configuration of the automatic exhaust station shown in FIG. 4.

FIG. 4 is a perspective view illustrating a configuration of the automatic exhaust station according to an exemplary embodiment of the present disclosure. FIG. 5 is a plan view illustrating the configuration of the automatic exhaust station shown in FIG. 4.

Referring to FIGS. 1 to 5, the automatic exhaust station 2 is adapted to allow the robot cleaner 1 to dock therewith. When the robot cleaner 1 completely docks with the automatic exhaust station 2, dust collected in the dust box 5 is automatically exhausted to the automatic exhaust station 2. The automatic exhaust station 2 also functions to charge the robot cleaner 1 by supplying current to the robot cleaner 1 via charging terminals 52*a* and 52*b*.

The automatic exhaust station 2 includes a platform 55, and a housing 51 formed at an end of the platform 55. A docking guide unit (not shown), a dust exhaust unit 61, and a controller (not shown) are arranged within the housing 51.

The platform 55 is a flat area along which the robot cleaner 1 moves. The platform 55 has an inclined structure to allow the robot cleaner 1 to easily ascend along or descend from the platform 55. A caster guide 53 may be formed at the platform 55, to guide the caster 38 of the robot cleaner 1. Driving wheel guides 54*a* and 54*b* may also be formed at the platform 55, to guide the left and right driving wheels 39*a* and 39*b* of the robot cleaner 1. The caster guide 53 and driving wheel guides 54*a* and 54*b* may be formed to be recessed, as compared to portions of the platform 55 therearound.

A second opening 56 is formed through the platform 55. The second opening 56 of the platform 55 is arranged at a position where the second opening 56 may communicate with the first opening 41 of the robot cleaner 1. In accordance with this arrangement, dust discharged through the first opening 41 of the robot cleaner 1 may be introduced into the second opening 56 of the platform 55. The dust introduced into the second opening 56 of the platform 55 may be collected in a dust box 65 included in the automatic exhaust station 2.

Meanwhile, the dust exhaust unit 61 is installed in the housing 51. The dust exhaust unit 61 functions to perform a function to exhaust dust collected in the dust box 5 of the robot cleaner 1 to the dust box 65 of the automatic exhaust station 2.

The dust exhaust unit 61 includes a pump unit 61, a suction duct 63, and discharge ducts 64*a* and 64*b*, in addition to the dust box 65.

The pump unit 62 is a device to suck/discharge air. The pump unit 62 includes a fan and a motor.

The suction duct 63 is installed at a suction side of the pump unit 62. The suction duct 63 includes a suction port 57, which forms a portion of the second opening 56.

The discharge ducts 64*a* and 64*b* are installed at a discharge side of the pump unit 62. The discharge duct 64*a* includes discharge ports 58*a* and 59*a*, which form portions of the second opening 56. Similarly, the discharge duct 64*b* includes discharge ports 58*b* and 59*b*, which form portions of the second opening 56. The discharge ports 58*a*, 58*b*, 59*a*, and 59*b* are formed at a longitudinal end of the second opening 56. The discharge ports 58*a*, 58*b*, 59*a*, and 59*b* are divided into first discharge ports 58*a* and 58*b* forwardly inclined from a vertical direction by a desired angle and second discharge ports 59*a* and 59*b* forwardly inclined from the vertical direction by a smaller angle than the first discharge ports 58*a* and 58*b*.

The sum of the cross-sectional areas of the discharge ports 58*a*, 58*b*, 59*a*, and 59*b* is less than the cross-sectional area of the suction port 57. Since the suction flow rate and discharge flow rate of the pump unit 62 are substantially equal, the flow velocity of discharged air E at the discharge ports 58*a*, 58*b*, 59*a*, and 59*b* is higher than the flow velocity of sucked air S at the suction port 57 due to the cross-sectional area difference between the discharge ports 58*a*, 58*b*, 59*a*, and 59*b* and the suction port 57. By virtue of this flow velocity difference, it may be possible to prevent air emerging from the discharge ports 58*a*, 58*b*, 59*a*, and 59*b* from being directly sucked into the suction port 57.

That is, the discharged air E emerging from the discharge ports 58*a*, 58*b*, 59*a*, and 59*b* may be injected into the interior of the dust box 5 of the robot cleaner 1 docking with the automatic exhaust station 2 in spite of the sucked air S because the air flow velocity of the discharged air E is very high. Air injected into the dust box 5 may be again sucked into the suction port 57 after circulating through the dust box 5.

In accordance with the above-described configuration, air circulated by the dust exhaust unit 61 in a docking mode may form a closed loop. That is, air discharged from the pump unit 62 rapidly emerges from the discharge ports 58*a*, 58*b*, 59*a*, and 59*b* of the discharge ducts 64*a* and 64*b*, and then enters the dust box 5 of the robot cleaner 1 after passing through the opposite side regions of the first opening 41. The air introduced into the dust box 5 of the robot cleaner 1 is introduced into the suction port 57 after passing through the central region of the first opening 41 of the robot cleaner 1. Subsequently, the air is guided by the suction duct 63 into the dust box 65 of the automatic exhaust station 2.

Figure 6:
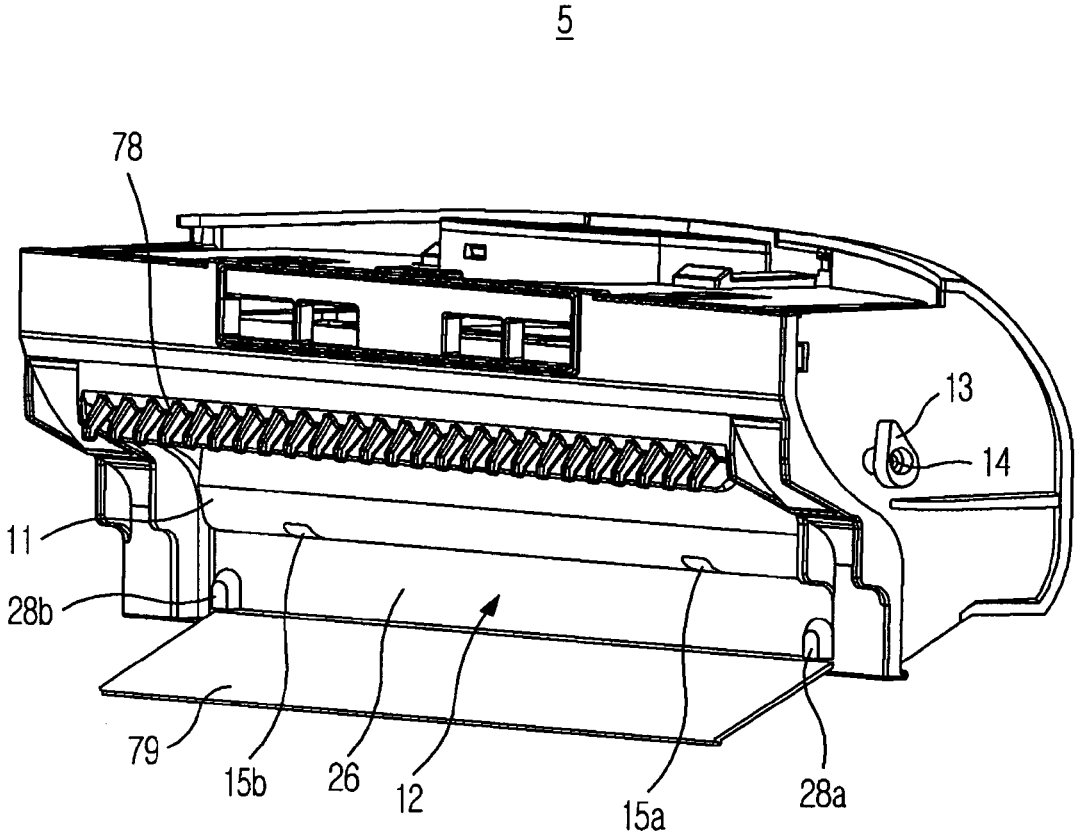
FIG. 6 is a perspective view illustrating a configuration of a dust box in the robot cleaner according to an exemplary embodiment of the present disclosure in a state in which both the first and second shutters of the dust box are closed (that is, a state in which the dust box is separated from the body)

FIG. 6 is a perspective view illustrating a configuration of the dust box of the robot cleaner according to an exemplary embodiment of the present disclosure in a state in which both the first and second shutters of the dust box are closed (that is, a state in which the dust box is separated from the body).

Figure 7:
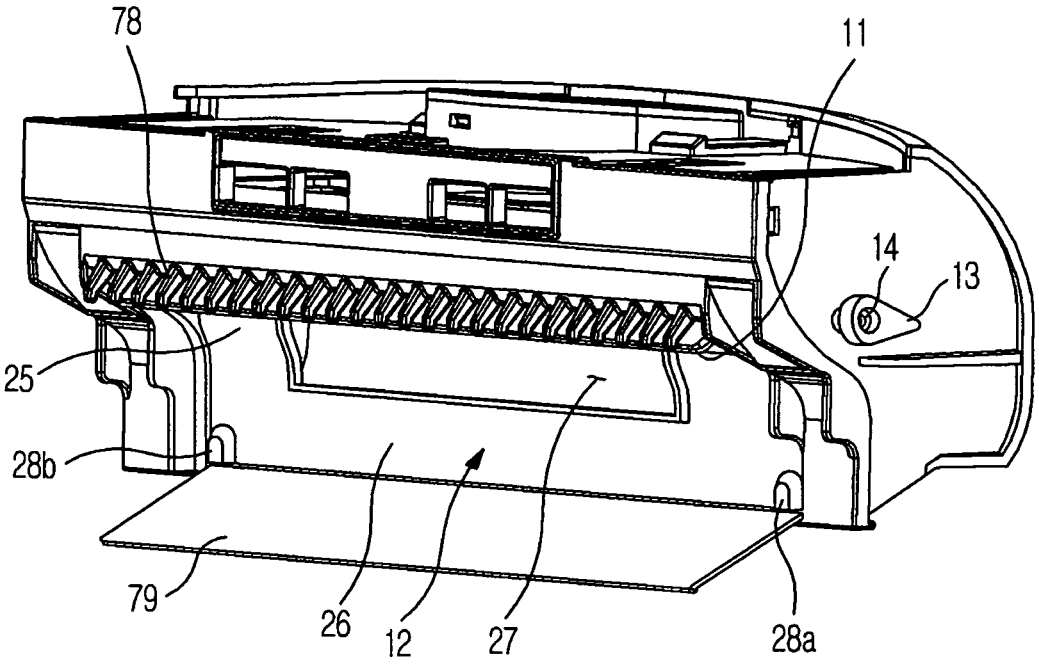
FIG. 7 is a perspective view illustrating the dust box according to the embodiment of FIG. 6 in a state in which the first shutter is opened, and the second shutter is closed (namely, a mounted state of the dust box to the body)

FIG. 7 is a perspective view illustrating the dust box according to the illustrated embodiment of the present disclosure in a state in which the first shutter is opened, and the second shutter is closed (namely, a state in which the dust box is mounted to the body).

Figure 8:
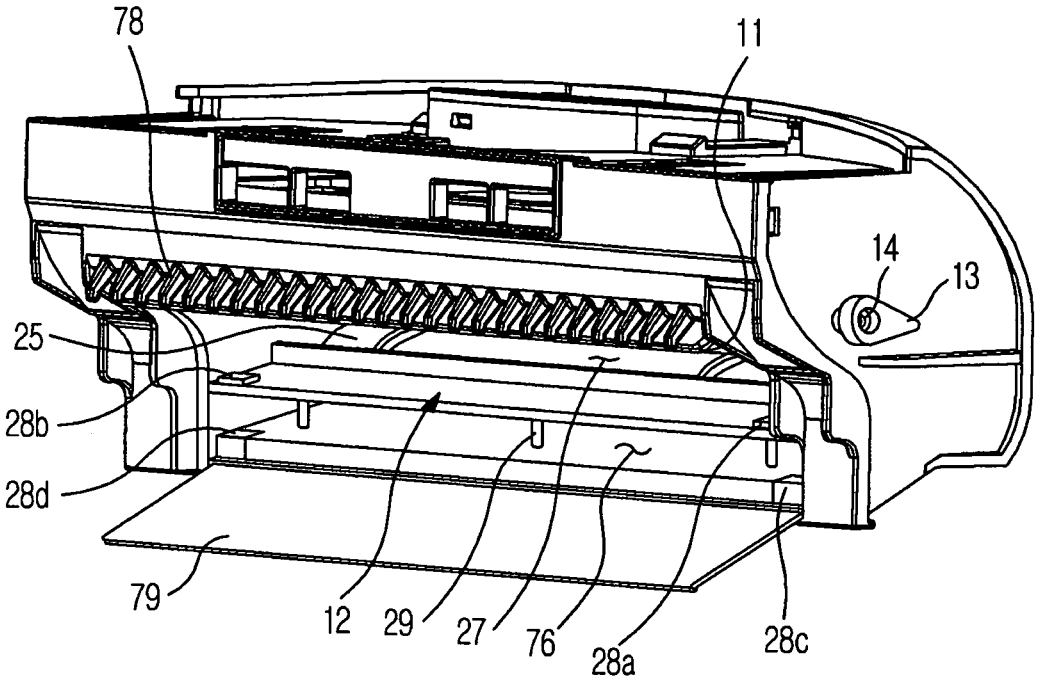
FIG. 8 is a perspective view illustrating the state in which both the first and second shutters of the dust box according to the embodiment of the FIG. 6 are opened (that is, an automatic exhaust mode).

FIG. 8 is a perspective view illustrating the state in which both the first and second shutters of the dust box according to the illustrated embodiment of the present disclosure are opened (that is, an automatic exhaust mode).

Figure 9:
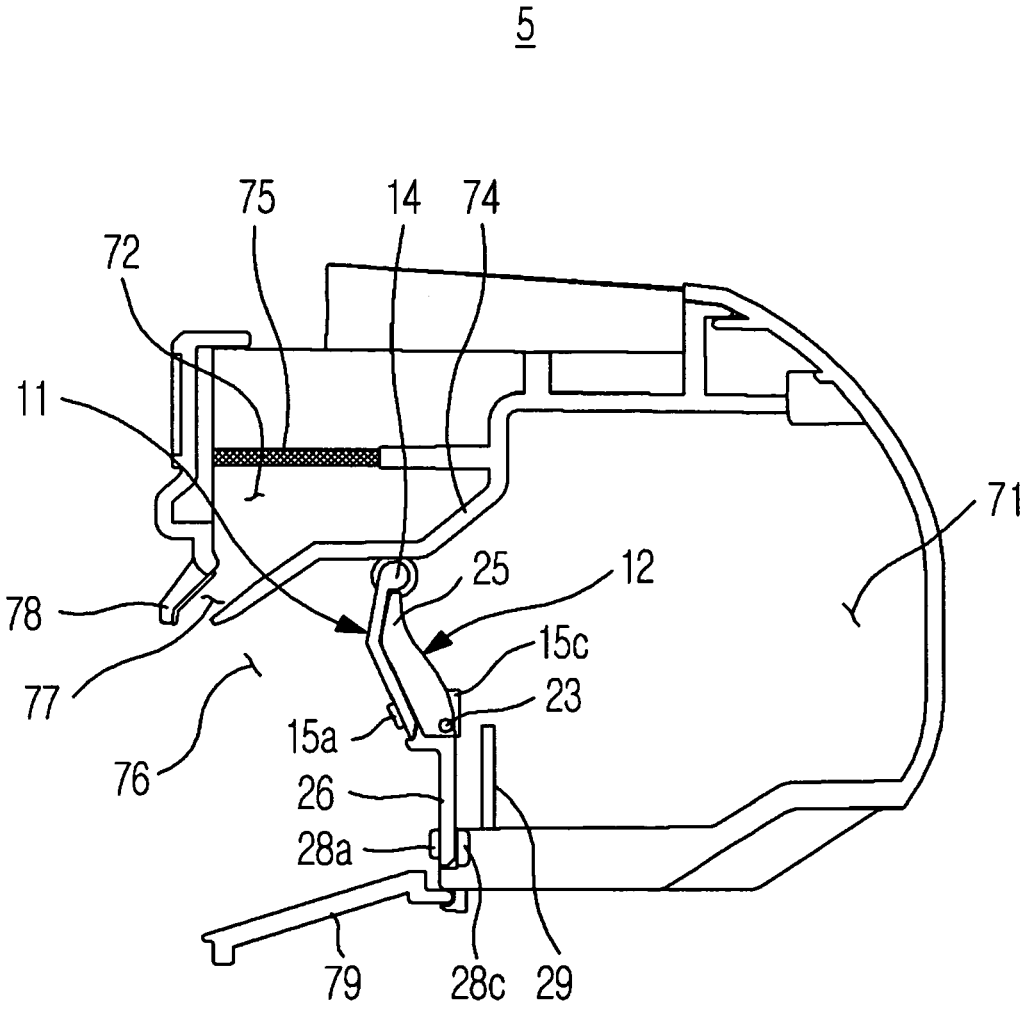
FIG. 9 is a sectional view corresponding to FIG. 6.
Figure 10:
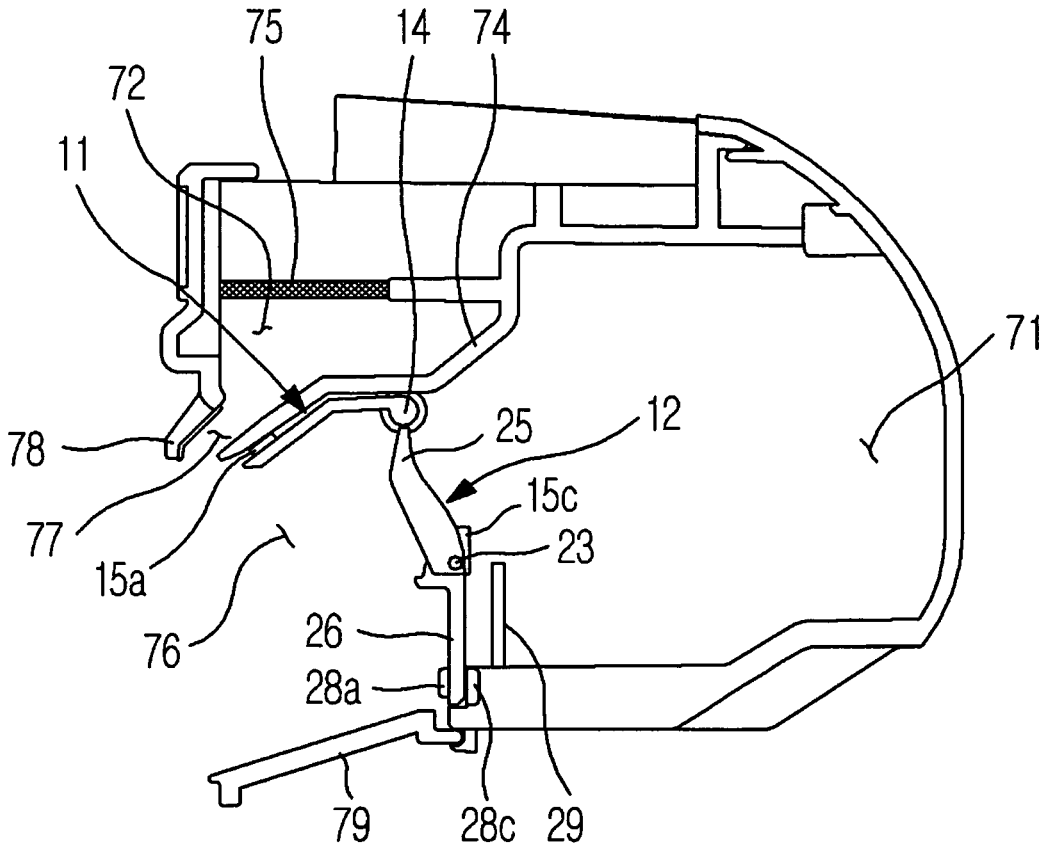
FIG. 10 is a sectional view corresponding to FIG. 7.
Figure 11:
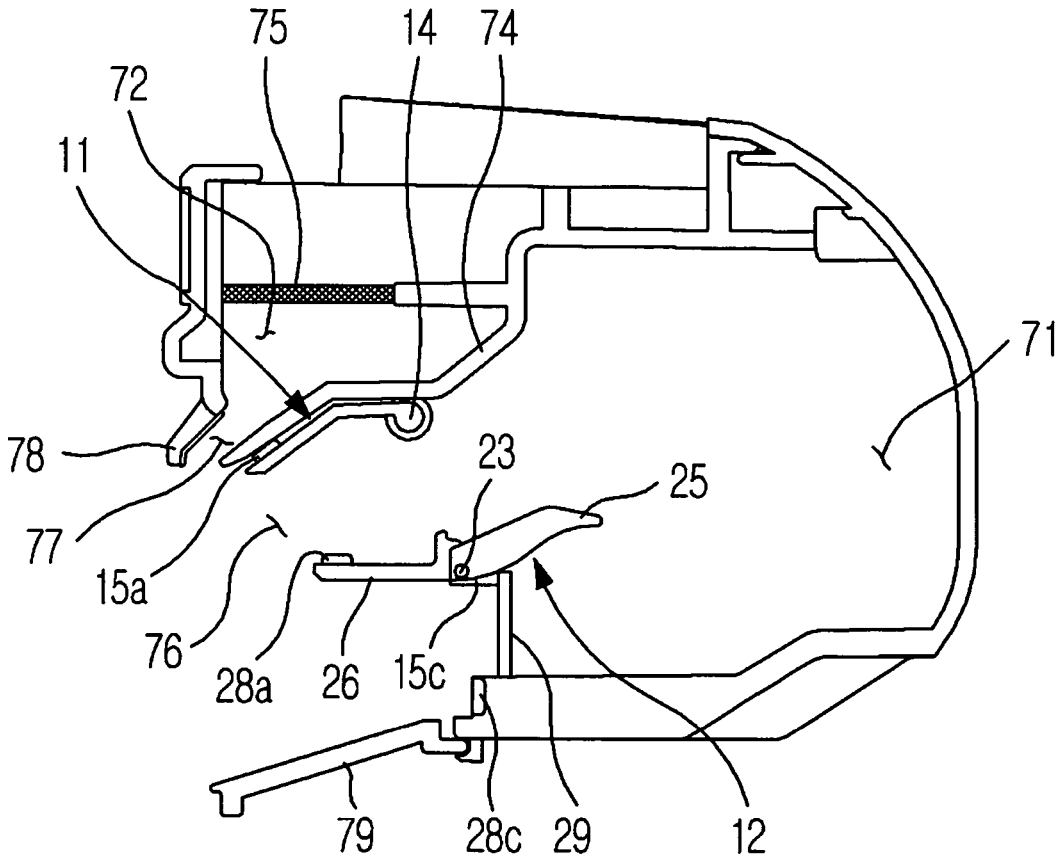
FIG. 11 is a sectional view corresponding to FIG. 8.

FIGS. 9 to 11 are sectional views corresponding to FIGS. 6 to 8, respectively.

Hereinafter, structures of the first and second shutters 11 and 12 of the dust box 5 according to an exemplary embodiment of the present disclosure will be described with reference to FIGS. 1 to 11.

As described above, the dust box 5 of the robot cleaner 1 includes the first storage chamber 71, which is disposed at a lower portion of the dust box 5 to collect heavy dust, and the second storage chamber 72, which is disposed at an upper portion of the dust box 5 to collect relatively light dust. The first and second dust box inlets 76 and 77 are formed at the first and second storage chambers 71 and 72, respectively.

The dust box 5 is separable from the body 4. Accordingly, the user may exhaust dust from the first and second storage chambers 71 and 72 after separating the dust box 5 from the body 4.

Meanwhile, the first and second shutters 11 and 12 are mounted to the dust box 5, to open or close the first dust box inlet 76.

The second shutter 12 is rotatably coupled to a central portion of the first dust box inlet 76. The second shutter 12 includes a rotating shaft 23 extending in a longitudinal direction of the first dust box inlet 76.

As shown in FIG. 7, the second shutter 12 is formed with a shutter opening 27 to allow air and dust to pass through the second shutter 12 even in a closed state of the second shutter 12. The shutter opening 27 is formed by cutting an upper central portion of the second shutter 12.

Accordingly, it may be possible to collect dust through the second shutter opening 27 even in a closed state of the second shutter 12. Thus, the second shutter 12 functions as a backflow preventing member to prevent dust collected in the dust box 5 from being discharged out of the dust box 5.

The second shutter 12 has an upper portion 25, and a lower portion 26 that is slightly heavier than the upper portion 25. In accordance with this structure, when no external force is applied to the second shutter 12, the lower portion 26 is downwardly directed, and the upper portion 25 is upwardly directed by gravity to naturally close the first dust box inlet 76.

Of course, when the dust box 5 is inclined or shaken, the second shutter 12 may be swung. To this end, moving magnets 28*a* and 28*b* are mounted to opposite surfaces of the lower portion 26 of the second shutter 12, respectively, to maintain sealability of the second shutter 12.

Fixed magnets 28*c* and 28*d* are mounted to an inner surface of the dust box 5 at positions corresponding to the moving magnets 28*a* and 28*b*. By virtue of magnetic attraction between the moving magnets 28*a* and 28*b* and the fixed magnets 28*c* and 28*d*, the second shutter 12 is kept closed.

The moving magnets 28*a* and 28*b* may be arranged at a front surface of the second shutter 12 in order to prevent the magnetic attraction from being excessively increased due to direct contact between the moving magnets 28*a* and 28*b* and the fixed magnets 28*c* and 28*d*.

The moving magnets 28*a* and 28*b* and the fixed magnets 28*c* and 28*d* may be niobium magnets. Such niobium magnets are suitable for the robot cleaner 1 according to the illustrated embodiment of the present disclosure because they have high mechanical strength to exhibit reduced breakage while having low specific weight to achieve miniaturization and lightness.

As described above, the second shutter 12 is closed by gravity while being opened by first exhaust air E1 discharged out of the automatic exhaust station 2.

As shown in FIGS. 8 and 11, when the pressure of exhaust air E1 discharged out of the automatic exhaust station 2 is applied to the upper portion 25 of the second shutter 12, the second shutter 12 is rotated such that the upper portion 25 of the second shutter 12 is inserted into the dust box 5, and the lower portion 26 of the second shutter 12 is outwardly protruded from the dust box 5. Thus, the first dust box inlet 76 is opened.

In particular, since the second shutter 12 is rotated such that the lower portion 26 of the second shutter 12 is outwardly protruded from the dust box 5, it may be possible to prevent dust collected in the first storage chamber 71 from being inwardly pushed into the first storage chamber 71 or from being jammed between the second shutter 12 and the inner surface of the dust box 5.

When the second shutter 12 is opened, even the heavy dust collected in the first storage chamber 71 may be easily discharged out of the dust box 5 through a lower portion of the first dust box inlet 76.

Since magnetic force is applied between respective moving magnets 28*a* and 28*b* and respective fixed magnets 28*c* and 28*d* in order to keep the second shutter 12 closed, the intensity of the first exhaust air E1 should be greater than the sum of the magnetic forces applied between respective moving magnets 28*a* and 28*b* and respective fixed magnets 28*c* and 28*d*.

A plurality of stoppers 29 is provided at the dust box 5 to support the upper portion 25 of the second shutter 12 when the second shutter 12 rotates, in order to stop the second shutter 12 about at a 90°-rotated position. The stoppers 29 have a bar structure extending upwardly from an inner bottom surface of the dust box 5 by a certain length. The stoppers 29 are spaced apart from one another by a certain distance, so as not to interfere with discharge of dust.

Thus, when the first exhaust air E1 is applied to the second shutter 12, the second shutter 12 is stopped after rotating to a position where it is substantially horizontally arranged as it comes into contact with the stoppers 29, without rotating continuously.

Hereinafter, the relation between the automatic exhaust station 2 and the second shutter 12 as described above will be described.

The robot cleaner 1 and automatic exhaust station 2 are configured so that, when the robot cleaner 1 docks with the automatic exhaust station 2, exhaust air E1 discharged through the first discharge ports 58*a* and 58*b* of the automatic exhaust station 2 is directed to the upper portion 25 of the second shutter 12, whereas exhaust air E2 discharged through the second discharge ports 59*a* and 59*b* is directed to the second storage chamber 72 of the dust box 5.

When the first exhaust air E1 discharged through the first discharge ports 58*a* and 58*b* is applied to the upper portion 25 of the second shutter 12, the second shutter 12 is rotated, thereby opening the first dust box inlet 76. At this time, dust collected in the first storage chamber 71 is sucked into the automatic exhaust station 2 by suction air S directed to the suction port 57 of the automatic exhaust station 2.

The exhaust air E2 directed to the second storage chamber 72 upwardly floats light dust collected in the second storage chamber 72. The floated dust is also sucked into the automatic exhaust station 2 by the suction air S.

Meanwhile, the first shutter 11 is provided at the dust box 5 in order to open or close the first dust box inlet 76, in addition to the second shutter 12, as described above.

The first shutter 11 has a size capable of opening or closing the shutter opening 27 of the second shutter 12. The first shutter 11 includes a rotating shaft 14 arranged at an upper end of the first dust box inlet 76 while extending in the longitudinal direction of the first dust box inlet 76.

The first shutter 11 has one end coupled to the rotating shaft 14. When the first shutter 11 is closed, the other end of the first shutter 11 comes into contact with a lower end of the first dust box inlet 76 to close the second shutter opening 27.

Thus, the first shutter 11 is pivotally coupled to the upper end of the first dust box inlet 76 such that it pivots outwardly of the first storage chamber 71 to be opened. Accordingly, even when the amount of dust collected in the first storage chamber 71 is large, the opening operation of the first shutter 11 is not obstructed by the dust.

Meanwhile, levers 13 are formed integrally with the first shutter 11 to pivot the first shutter 11.

The levers 13 are arranged at opposite axial ends of the rotating shaft 14, respectively, while substantially having an arc shape. When the levers 13 are rotated by external force, the first shutter 11 is rotated because the levers 13 are integral with the first shutter 11.

When no external force is applied to the levers 13, the first shutter 11 closes the first dust box inlet 76 by gravity.

Similarly to the second shutter 12, moving magnets 15*a* and 15*b* are mounted to the first shutter 11, to keep the first shutter 11 closed.

Fixed magnets 15*c* are mounted to the front surface of the second shutter 12 at positions corresponding to the moving magnets 15*a* and 15*b*, respectively, to generate magnetic attraction between the moving magnets 15*a* and 15*b* and the fixed magnets 15*c* (In the drawings, only one fixed magnet 15*c* is shown).

The moving magnets 15*a* and 15*b* and the fixed magnets 15*c* may be arranged at opposite sides of the first and second shutters 11 and 12, respectively, in order to prevent the magnetic attraction from being excessively increased.

The system, which uses magnetic forces of magnets, as described above, is efficient in that the configuration thereof is simple, and there is no possibility of dust being jammed in the system, as compared to the system which uses elastic forces of springs.

Figure 12:
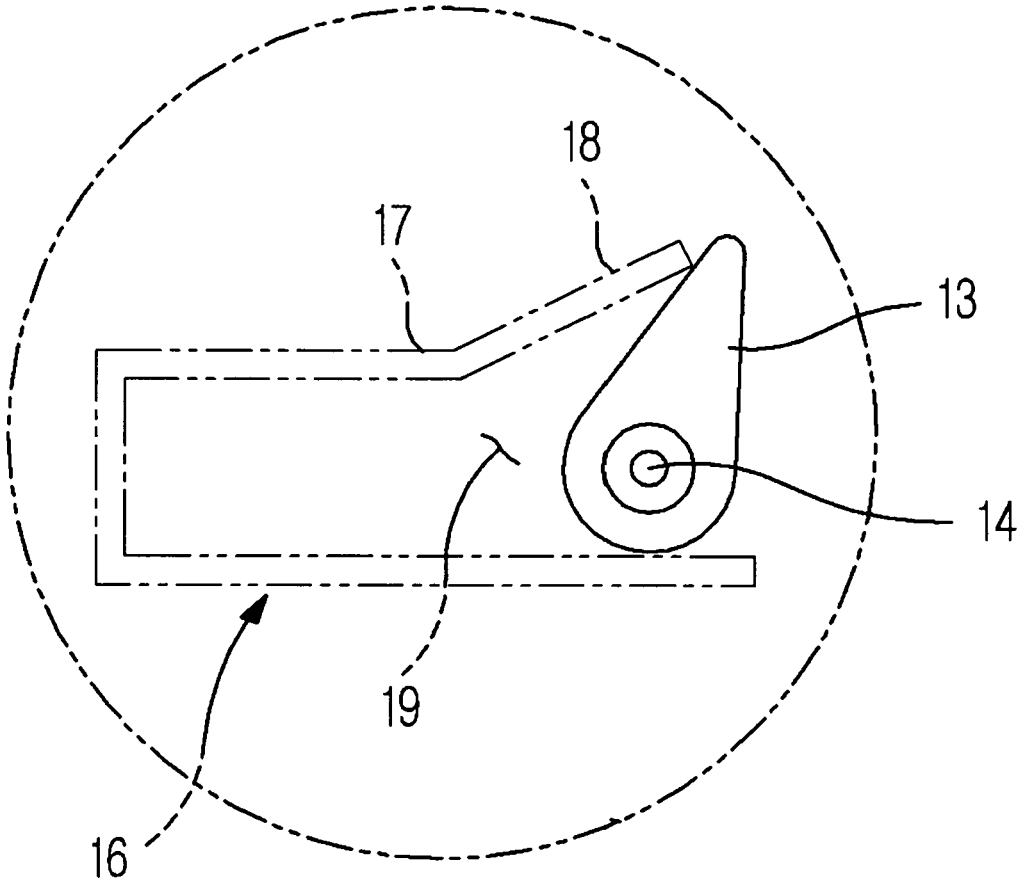
FIG. 12 is a view illustrating a lever and a guide in a closed state of the first shutter to explain structures of the lever and guide according to an exemplary embodiment of the present disclosure.

FIG. 12 is a view illustrating one lever and a guide in a closed state of the first shutter to explain structures of the lever and guide according to an exemplary embodiment of the present disclosure.

Figure 13:
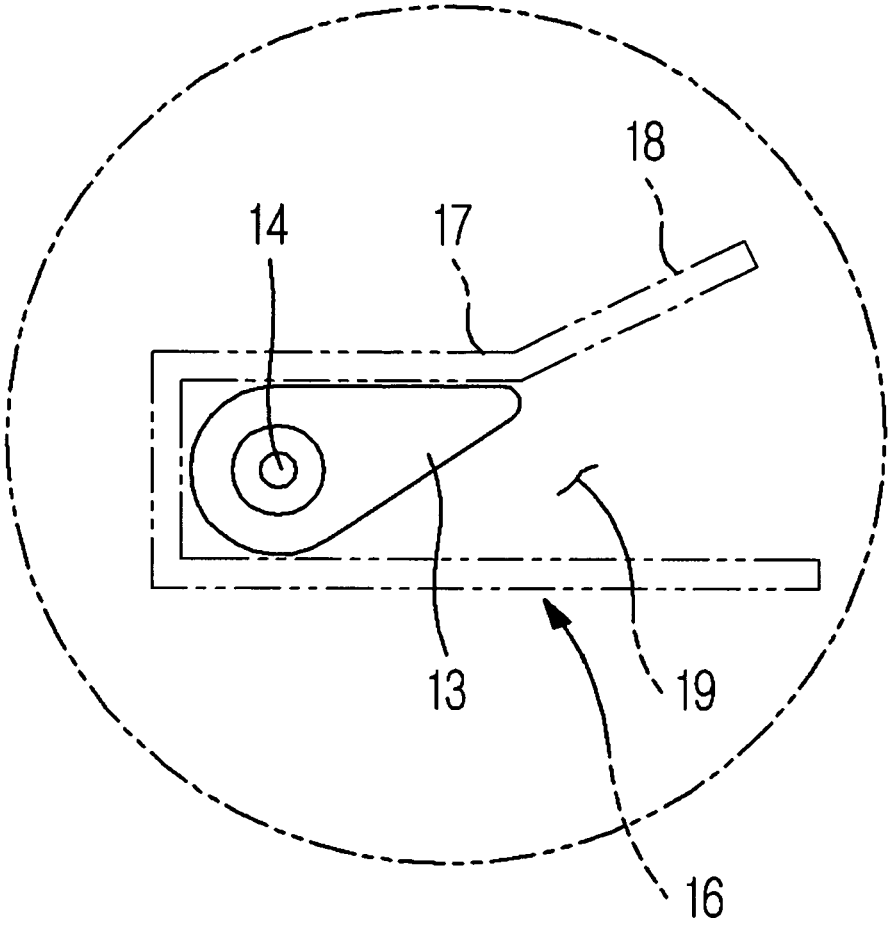
FIG. 13 is a view illustrating the lever and guide in an opened state of the first shutter to explain the structures of the lever and guide according to the illustrated embodiment of the present disclosure.

FIG. 13 is a view illustrating the lever and guide in an opened state of the first shutter to explain the structures of the lever and guide according to the illustrated embodiment of the present disclosure.

Guides 16 are formed at an inner surface of the body 4 at positions corresponding to the levers 13 of the dust box 5 to press the levers 13, respectively.

As shown in FIGS. 12 and 13, each guide 16 includes a holding portion 19 to guide and hold the corresponding lever 13, and a pushing portion 17 to press the lever 13.

During a procedure of mounting the dust box 5 to the body 4, the levers 13 of the dust box 5 are pressed by the corresponding pushing portions 17, respectively, to be rotated about the rotating shaft 14. At this time, the first shutter 11 integral with the levers 13 pivots, thereby opening the first dust box inlet 76.

On the contrary, when the dust box 5 is separated from the body 4, the external force applied to the levers 13 by the pushing portions 17 is released. Accordingly, the first shutter 11 rotates in an opposite direction by gravity, thereby closing the first dust box inlet 76.

Meanwhile, each guide 16 also includes an inclined portion 18 extending inclinedly from the pushing portion 17 of the guide 16. The inclined portion 18 allows the corresponding lever 13 to be gradually pressed by the pushing portion 17 without being instantaneously pressed.

When the dust box 5 approaches the body 4, each lever 13 first comes into contact with an upper end of the corresponding inclined portion 18, so that the lever 13 begins to rotate. As the dust box 5 further approaches the body 4, the lever 13 is pressed by a central part of the inclined portion 18, so that it is further rotated. When the dust box 5 completely approaches the body 4, the lever is pressed by a lower part of the inclined portion 18, so that it is rotated to an angle of about 90°.

Since each lever 13 is gradually rotated by the corresponding inclined portion 18 without being instantaneously rotated, impact applied to the first shutter 11 or dust box 5 is relieved, so that it may be possible to prevent dust collected in the dust box 5 from being dispersed.

The procedure of separating the dust box 5 from the body 4 is reverse to the procedure of mounting the dust box 5 to the body 4.

Heretofore, the configuration of the robot cleaner 1 according to the illustrated embodiment of the present disclosure has been described. Hereinafter, operation of the robot cleaner 1 according to an exemplary embodiment of the present disclosure will be described in brief.

In a separated state of the dust box 5 from the body 4, dust is not outwardly discharged out of the dust box 5 because both the first and second shutters 11 and 12 are closed, as shown in FIGS. 6 and 9. Since the first and second shutters 11 and 12 are kept closed by magnetic force, the closed states of the first and second shutters 11 and 12 are maintained even when the dust box 5 is slightly swung.

When the dust box 5 is mounted to the body 4, the guides 16 formed at the inner surfaces of the body 4 press respective levers 13, as shown in FIGS. 7 and 10. Accordingly, the first shutter 11 is opened while rotating forwards about the rotating shaft 14. In this case, the second shutter 12 is kept closed. Accordingly, the first dust box inlet 76 is kept closed only by the second shutter 12. Since the shutter opening 27 is formed at the upper central portion of the second shutter 12, it may be possible to collect dust into the first storage chamber 71 through the shutter opening 27. In this case, the second shutter 12 functions as a backflow preventing member to prevent dust collected in first storage chamber 71 from flowing backwards.

When a cleaning mode of the robot cleaner 1 is begun in the above state, the brush unit 35 sweeps dust accumulated on the floor, and collects the swept dust into the first storage chamber 71. Light dust, which may not be easily swept, is collected in the second storage space 1 by the suction force of the blowing unit 80.

When the robot cleaner 1, to which the dust box 5 is mounted, subsequently docks with the automatic exhaust station 2 to begin an automatic exhaust mode, first exhaust air E1 is blown toward the upper portion 25 of the second shutter 12 through the first discharge ports 58*a* and 58*b* of the automatic exhaust station 2, and second exhaust air E2 is blown toward the second storage chamber 72 through the second discharge ports 59*a* and 59*b* of the automatic exhaust station 2, as shown in FIGS. 8 and 11. Also, air present in the first and second storage chambers 71 and 72 is sucked toward the suction port 57 of the automatic exhaust station 2.

As a result, the second shutter 12 is rotated by the first exhaust air E1 blown through the first discharge ports 58*a* and 58*b* of the automatic exhaust station 2 such that the upper portion 25 of the second shutter 12 is directed to the inside of the dust box 5, and the lower portion 26 of the second shutter 12 is directed to the outside of the dust box 5. At this time, the second shutter 12 is opened while being rotated to an angle of about 90° as it comes into contact with the stopper members 29 provided at the dust box 5.

Meanwhile, dust collected in the second storage chamber 72 is upwardly raised by the second exhaust air E2 blown through the second exhaust ports 59*a* and 59*b* of the automatic exhaust station 2.

At the same time, the automatic exhaust station 2 sucks air to outwardly exhaust the dust collected in the first and second storage chambers 71 and 72. In particular, even heavy dust collected in the first storage chamber 71 may be easily exhausted because the second shutter 12, which has closed the lower portion of the first dust box inlet 76, is opened.

Heretofore, the robot cleaner according to one exemplary embodiment of the present disclosure has been described. Hereinafter, a robot cleaner according to another exemplary embodiment of the present disclosure will be described.

Figure 14:
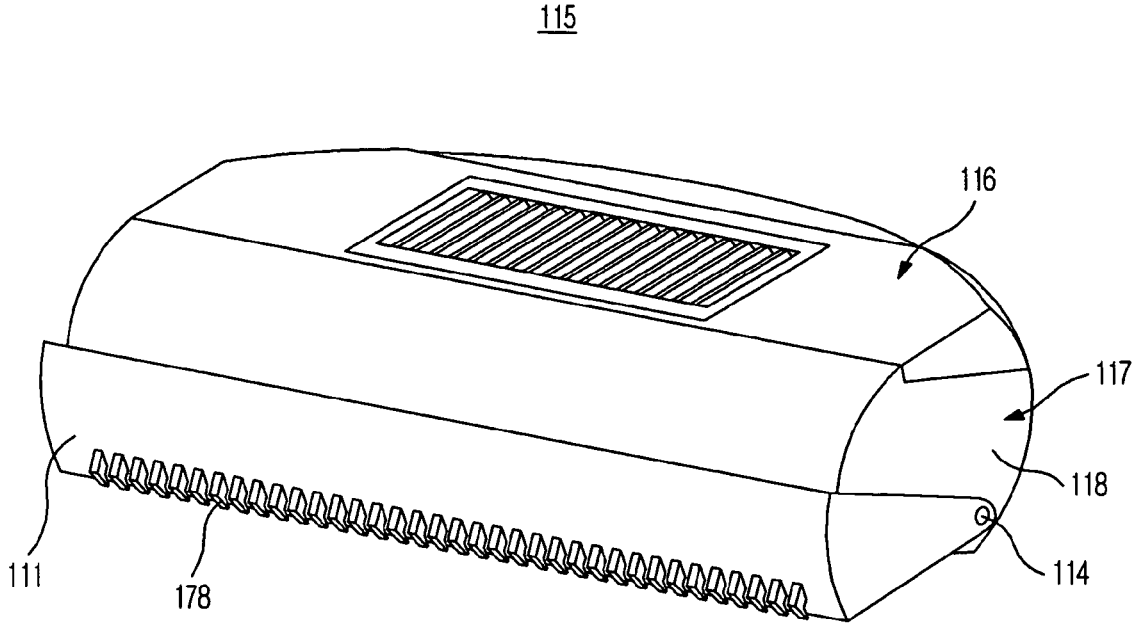
FIG. 14 is a perspective view illustrating a dust box included a robot cleaner according to another exemplary embodiment of the present disclosure in a state in which both the first and second shutters of the dust box are closed (namely, a separated state of the dust box from the body).

FIG. 14 is a perspective view illustrating a dust box included a robot cleaner according to another exemplary embodiment of the present disclosure in a state in which both the first and second shutters of the dust box are closed (namely, a separated state of the dust box from the body).

Figure 15:
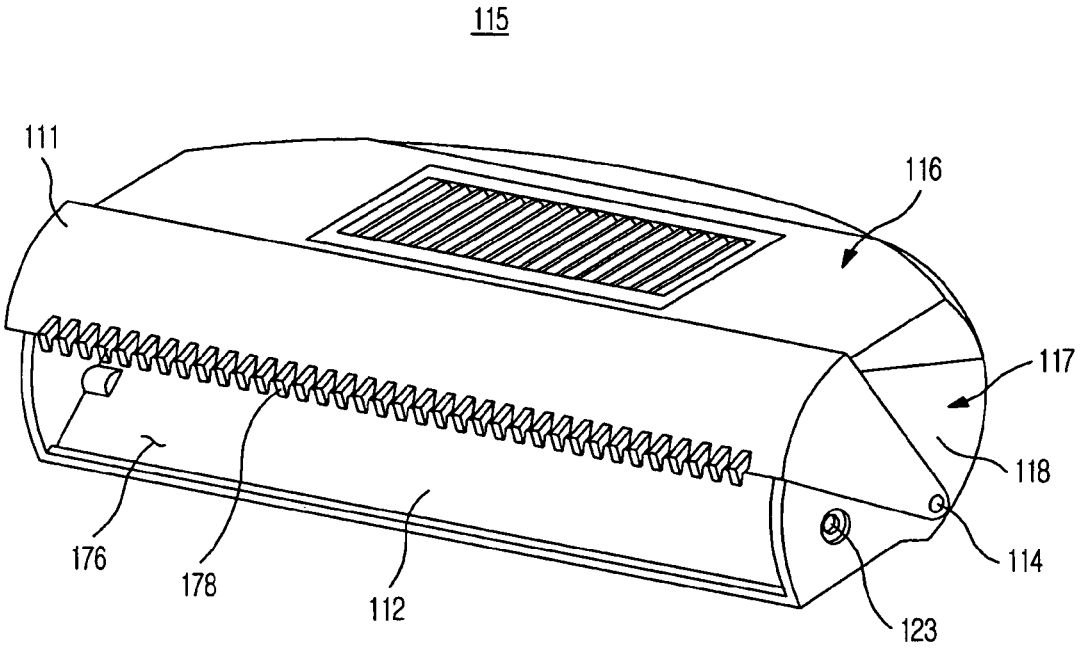
FIG. 15 is a perspective view illustrating the dust box according to the embodiment of FIG. 14 in a state in which the first shutter is opened, and the second shutter is closed (namely, a mounted state of the dust box to the body).

FIG. 15 is a perspective view illustrating the dust box according to the embodiment of FIG. 14 in a state in which the first shutter is opened, and the second shutter is closed (namely, a mounted state of the dust box to the body).

Figure 16:
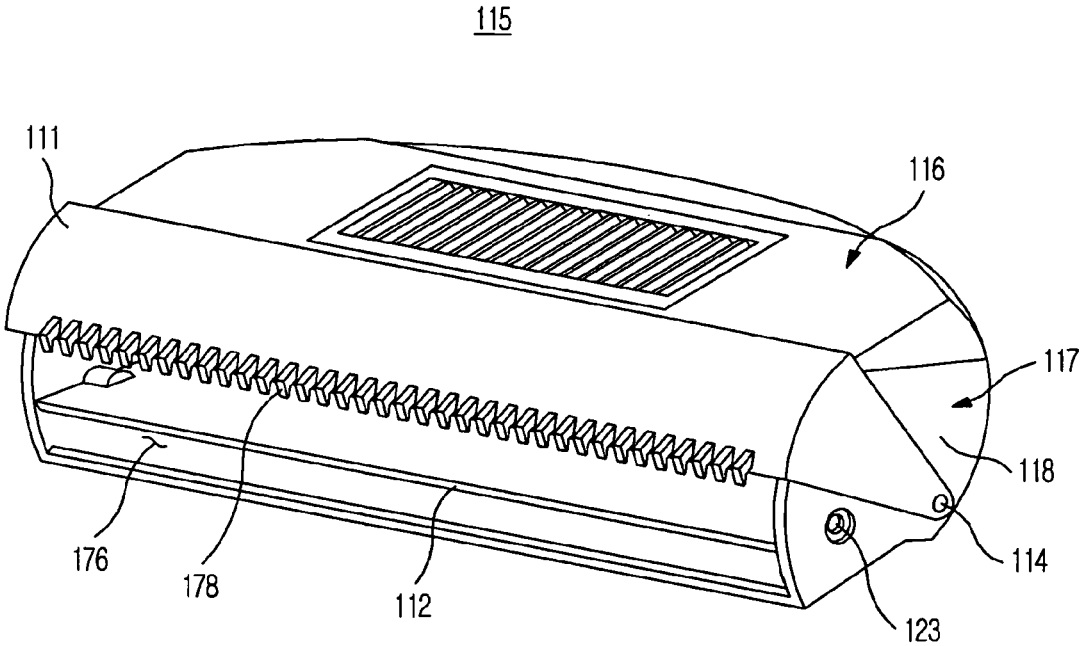
FIG. 16 is a perspective view illustrating the dust box according to the embodiment of FIG. 14 in a state in which both the first and second shutters are opened (namely, an automatic exhaust state)

FIG. 16 is a perspective view illustrating the dust box according to the embodiment of FIG. 14 in a state in which both the first and second shutters are opened (namely, an automatic exhaust state).

Figure 17:
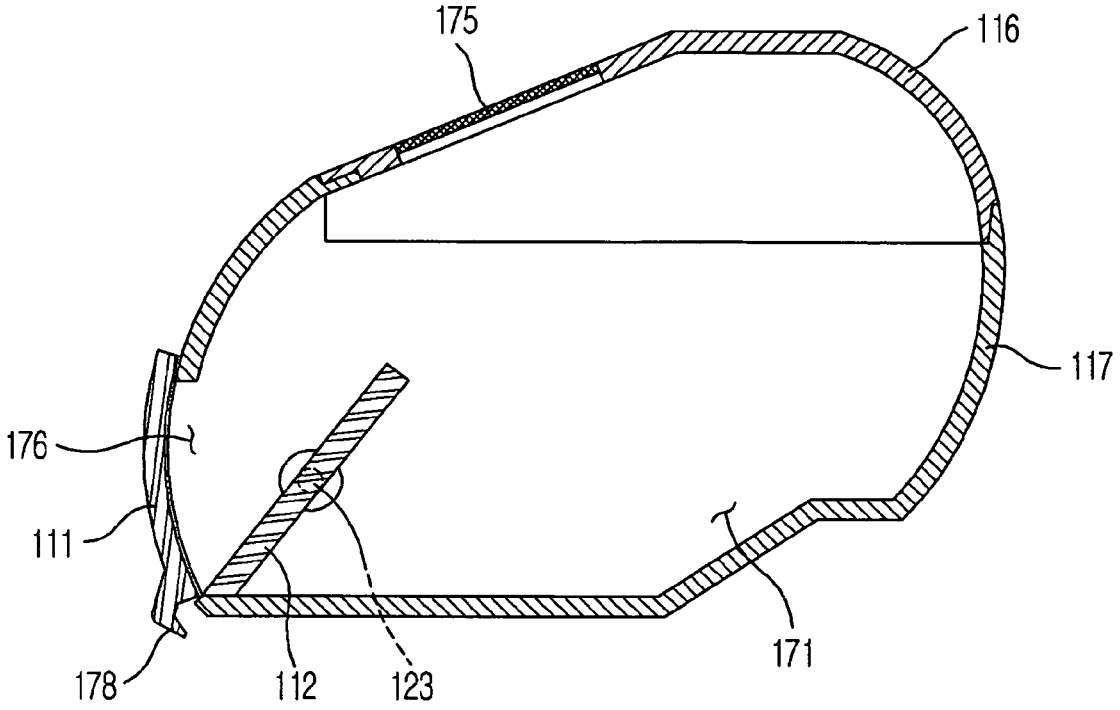
FIG. 17 is a sectional view corresponding to FIG. 14.
Figure 18:
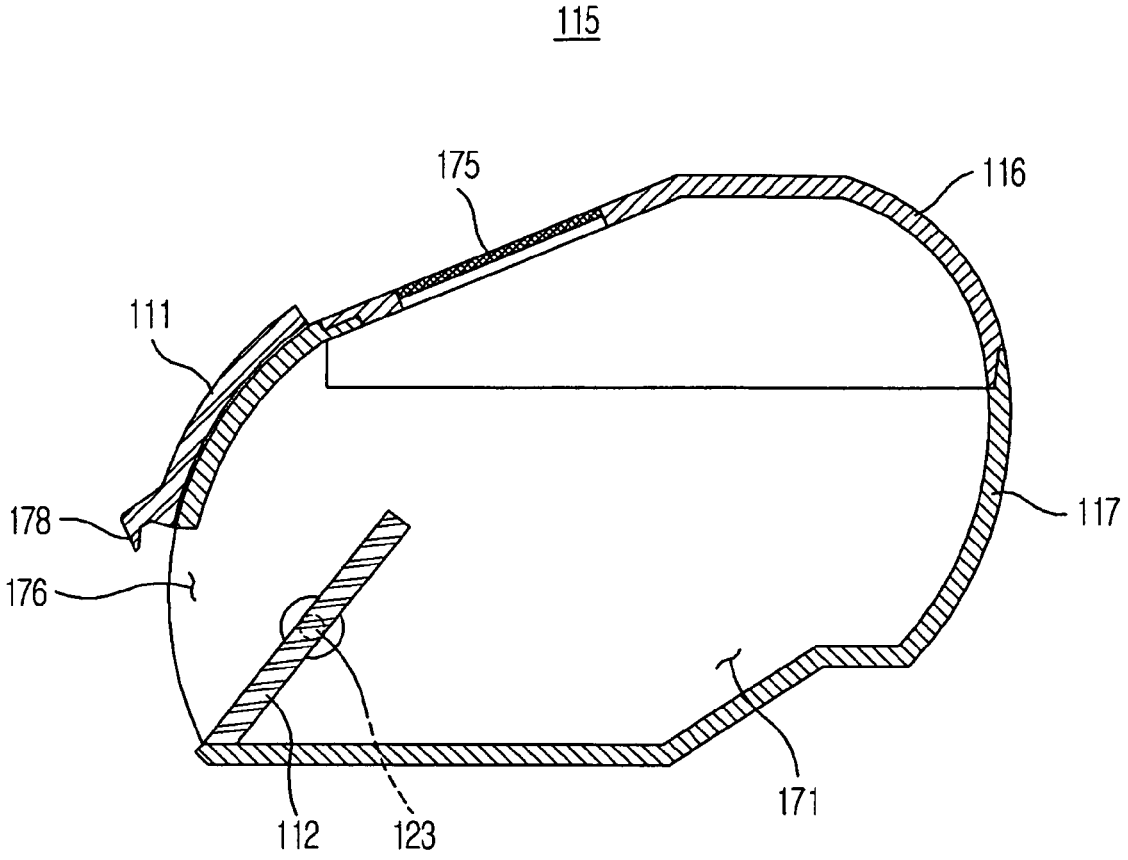
FIG. 18 is a sectional view corresponding to FIG. 15.
Figure 19:
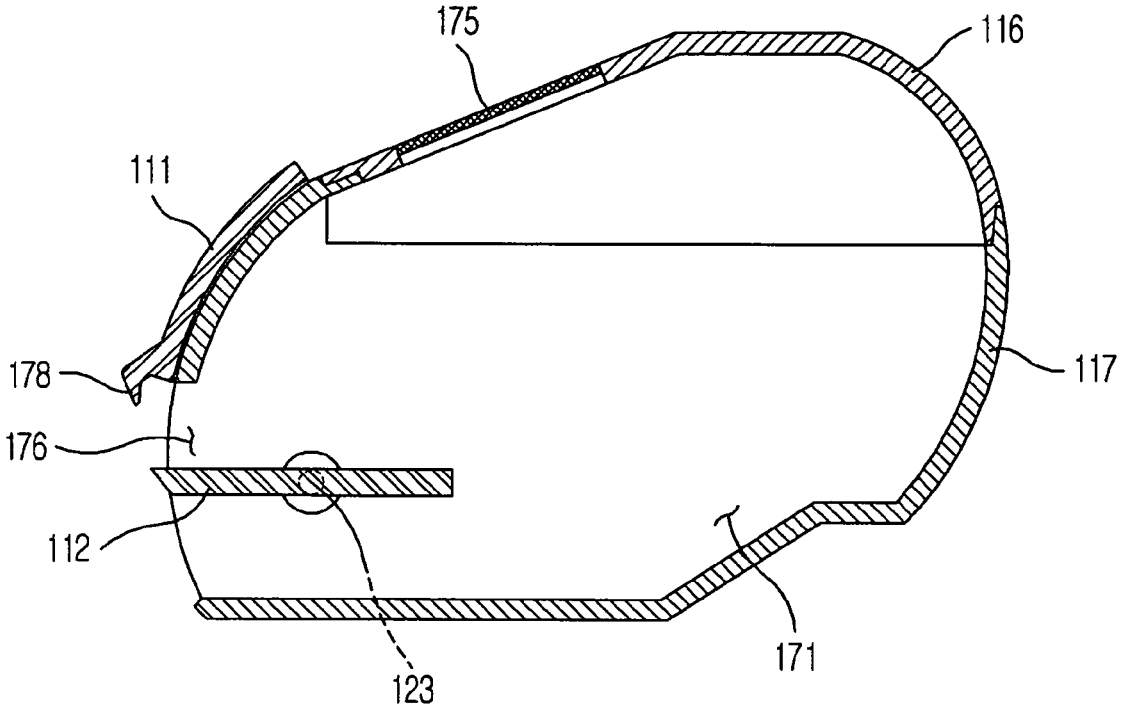
FIG. 19 is a sectional view corresponding to FIG. 16.

FIGS. 17 to 19 are sectional views respectively corresponding to FIGS. 14 to 16.

A part of the above-described constituent elements is also applied to the robot cleaner according to the present embodiment and, as such, no description thereof will be given. In the following description, only the difference of this embodiment from the previous embodiment will be described.

The dust box according to this embodiment, which is designated by reference numeral 115, includes a dust box body 117, and a dust box cap 116 separably mounted to the dust box body 117. The dust box cap 116 defines an outer appearance of the dust box 115, together with the dust box body 117. A third storage space 171 is defined in the dust box body 117. A filter 175 is mounted to the dust box cap 116, in order to prevent dust collected in the dust box 115 from being sucked into the body of the robot cleaner.

A dust box inlet 176 is formed at a front side of the dust box body 117 to allow dust to be introduced into or discharged from the storage space 171. A first shutter 111 and a second shutter 112 are also provided at the dust box body 117 to open or close the dust box inlet 176.

As shown in FIG. 14, the first shutter 111 is configured to completely open or close the dust box inlet 176. That is, when the first shutter 111 is closed, a lower end of the first shutter 111 comes into contact with a lower end of the dust box inlet 176.

The first shutter 111 is pivotally coupled to outer side surfaces 118 of the dust box body 117 by a hinge member 114, to pivot vertically. That is, the first shutter 111 performs pivotal movement along an outer surface of the dust box 115 without entering the storage space 181 of the dust box 115. Accordingly, there is no phenomenon that dust collected in the storage space 171 is jammed between the first shutter 111 and a wall of the dust box 115. Also, the dust box 115 has a simple structure.

Meanwhile, a brush cleaning member 178 is formed at the lower end of the first shutter 111. The brush cleaning member 178 has a rake shape to filter out foreign matter.

The second shutter 112 includes a rotating shaft 123 rotatably mounted to the dust box body 117 at a position inwardly spaced apart from the dust box inlet 176 by a certain distance. The second shutter 112 is inclinedly positioned when completely closed. Accordingly, dust may be collected in the dust box 115 even when the second shutter 112 is completely closed.

The second shutter 112 is rotated about the rotating shaft 123 by the first exhaust air E1 (FIG. 4) from the automatic exhaust station 2, so that the second shutter 112 is opened.

Figure 20:
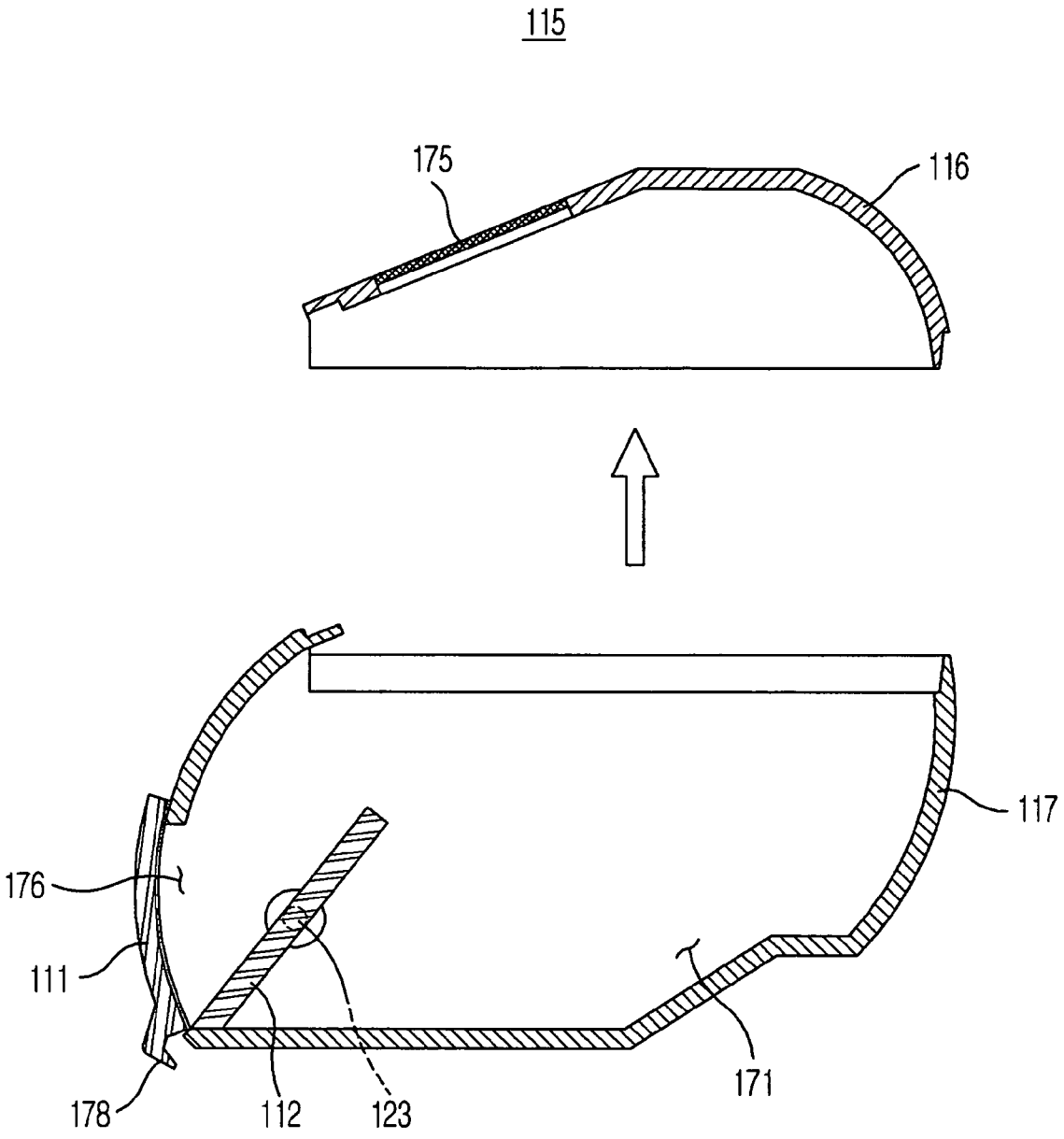
FIG. 20 is a view illustrating a state in which the dust box cap is separated from the dust box in accordance with the embodiment of FIG. 14.

FIG. 20 is a view illustrating a state in which the dust box cap is separated from the dust box in accordance with the embodiment of FIG. 14.

As described above, the dust box 115 includes the dust box body 117, which is configured to allow the user to easily directly exhaust dust from the dust box body 117, and the dust box cap 116, which is separably mounted to the dust box body 117. The user may easily exhaust dust after separating the dust box cap 116 from the dust box body 117.

As apparent from the above description, the present disclosure has features in that it includes a first shutter to prevent dust from being unintentionally discharged from a dust box when the dust box is separated from the body of a robot cleaner, and a second shutter to be automatically opened by exhaust air blown from an automatic exhaust station in an automatic exhaust mode carried out when the robot cleaner docks with the automatic exhaust station, in order to easily exhaust even heavy dust collected in the dust box.

The first shutter, which functions as an unintentional dust discharge preventing shutter, opens the inlet of the dust box when the dust box is mounted to the body of the robot cleaner, and closes the inlet of the dust box when the dust box is separated from the body. Thus, the first shutter prevents dust from being unintentionally discharged from the dust box.

Furthermore, the first shutter is kept closed by magnetic force, so that it is prevented from being easily opened even when the dust box is shaken or turned over.

Meanwhile, the second shutter, which functions as a backflow preventing member or an automatic exhaust shutter, is automatically opened when the robot cleaner exhausts dust from the dust box after docking with the automatic exhaust station. Accordingly, it may be possible to easily exhaust even heavy dust collected in the dust box.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A robot cleaner comprising:

a body;

a dust box separably mounted to the body, the dust box including a dust box inlet;

a first shutter rotatably coupled to the dust box; and a second shutter rotatably coupled to the dust box to open or close a portion of the dust box inlet, wherein the first shutter opens or closes a remaining portion of the dust box inlet.

2. The robot cleaner according to claim 1, wherein the first shutter includes a shutter rotating shaft arranged at the dust box inlet while extending in a longitudinal direction of the first dust box inlet.

3. The robot cleaner according to claim 1, wherein the first shutter is pivotally coupled to outer side surfaces of the dust box, to rotate vertically.

4. The robot cleaner according to claim 1, wherein the first shutter is opened when the first shutter is pressed by the body.

5. The robot cleaner according to claim 1, wherein the first shutter is closed by gravity when a pressing force applied from the body to the first shutter is removed.

6. The robot cleaner according to claim 1, further comprising:

a lever to rotate the first shutter.

7. The robot cleaner according to claim 6, wherein the body includes a guide to press the lever, thereby opening the first shutter.

8. The robot cleaner according to claim 7, wherein the guide includes an inclined portion to cause the guide to gradually press the lever.

9. The robot cleaner according to claim 1, further comprising:

a magnet mounted to the first shutter to keep the first shutter closed.

10. The robot cleaner according to claim 1, further comprising:

a brush cleaning member formed at an end of the first shutter.

11. The robot cleaner according to claim 1, wherein the second shutter includes a shutter rotating shaft arranged at the dust box inlet while extending in a longitudinal direction of the first dust box inlet.

12. The robot cleaner according to claim 1, wherein the second shutter is rotatably coupled to the body at a position inwardly spaced apart from the dust box inlet by a predetermined distance.

13. The robot cleaner according to claim 1, wherein the second shutter is opened by a pressure of air blown to the second shutter.

14. The robot cleaner according to claim 13, wherein the second shutter is closed by gravity when the air pressure is removed.

15. The robot cleaner according to claim 13, wherein the air pressure is generated by exhaust air discharged from an automatic exhaust station, with which the body docks.

16. The robot cleaner according to claim 13, wherein the air pressure is prevented from being applied to the second shutter when the first shutter is closed.

17. The robot cleaner according to claim 1, further comprising:

a stopper to limit a rotation range of the second shutter.

18. The robot cleaner according to claim 1, further comprising:

a magnet mounted to the second shutter to keep the second shutter closed.

19. A robot cleaner comprising:

a body;

a dust box separably mounted to the body, the dust box including a dust box inlet;

a first shutter rotatably coupled to the dust box such that the first shutter is opened when the dust box is mounted to the body while being closed when the dust box is separated from the body; and a second shutter rotatably coupled to the dust box such that the second shutter is opened when dust from the dust box is exhausted to an automatic exhaust station while being closed when the exhaust is completed.

20. A robot cleaner comprising:

a body;

a dust box separably mounted to the body, the dust box including a dust box inlet;

a shutter rotatably coupled to the dust box to open or close the dust box inlet; and a magnet mounted to the shutter to keep the shutter closed.

21. The robot cleaner according to claim 20, wherein the dust box includes a backflow preventing member to prevent dust collected in the dust box from flowing backwards.

22. A robot cleaner comprising:

a body;

a dust box separably mounted to the body, the dust box including a dust box inlet;

a first shutter rotatably coupled to the dust box such that the first shutter is opened when the dust box is mounted to the body while being closed when the dust box is separated from the body; and a second shutter rotatably coupled to the dust box to be rotated by a pressure of air blown to the shutter, thereby opening or closing the dust box inlet.

23. The robot cleaner according to claim 22, wherein the shutter prevents dust collected in the dust box from flowing backwards in a closed state of the second shutter.

24. A robot cleaner system including a robot cleaner, and an automatic exhaust station, with which the robot cleaner docks, wherein the robot cleaner comprises a body, a dust box separably mounted to the body, the dust box including a dust box inlet, a first shutter rotatably coupled to the dust box such that the first shutter is opened when the dust box is mounted to the body while being closed when the dust box is separated from the body, and a second shutter rotatably coupled to the dust box to be rotated by a pressure of air blown to the second shutter, thereby opening or closing the dust box inlet.

25. The robot cleaner system according to claim 24, wherein:

the automatic exhaust station includes a discharge duct and a suction duct; and the second shutter is rotated by air discharged from a discharge portion of the discharge duct, and dust from the dust box is sucked into a suction port of the suction duct by air sucked toward the suction port of the suction duct.

* * * * *